US007150284B2

(12) United States Patent
Aulbers et al.

(10) Patent No.: US 7,150,284 B2
(45) Date of Patent: Dec. 19, 2006

(54) DEVICE FOR MONITORING A WASH PROCESS

(75) Inventors: Anton Aulbers, Eindhoven (NL); Leonard Marcus Flendrig, Vlaardingen (NL); Evert Nieuwkoop, Delft (NL); Hank Robert Reinhoudt, Vlaardingen (NL); Alexandru Volanschi, Vlaardingen (NL); Johannes Van Der Werff, Eindhoven (NL)

(73) Assignee: JohnsonDiversey, Inc., Sturtevant, WI (US)

( * ) Notice: Subject to any disclaimer, the term of this patent is extended or adjusted under 35 U.S.C. 154(b) by 657 days.

(21) Appl. No.: 10/013,799

(22) Filed: Dec. 11, 2001

(65) Prior Publication Data

US 2002/0078979 A1 Jun. 27, 2002

(30) Foreign Application Priority Data

Dec. 15, 2000 (EP) ..... 00204536

(51) Int. Cl.
*D06F 3/02* (2006.01)

(52) U.S. Cl. ..... 134/56 R; 134/113; 134/57 R; 134/58 R

(58) Field of Classification Search ..... 134/56 R, 134/57 R, 58 R, 113, 200; 73/60.11, 61.44; 68/13 R, 213, 235 R
See application file for complete search history.

(56) References Cited

U.S. PATENT DOCUMENTS

| | | | | | |
|---|---|---|---|---|---|
| 2,370,609 | A | * | 2/1945 | Wilson et al. | 324/448 |
| 2,525,754 | A | * | 10/1950 | Albrecht | 324/448 |
| 2,560,209 | A | * | 7/1951 | Borell et al. | 324/448 |
| 3,238,452 | A | * | 3/1966 | Schmitt et al. | 324/666 |
| 3,245,260 | A | * | 4/1966 | Werner | 374/148 |
| 3,657,073 | A | * | 4/1972 | Burton et al. | |
| 3,861,875 | A | * | 1/1975 | Joslyn | |
| 3,911,256 | A | * | 10/1975 | Jones | 702/47 |
| 4,277,151 | A | * | 7/1981 | Schonhut | 351/41 |
| 4,329,649 | A | * | 5/1982 | Scoates | 324/438 |
| 4,390,620 | A | * | 6/1983 | Junter et al. | 205/777.5 |
| 4,509,543 | A | * | 4/1985 | Livingston et al. | 134/57 D |
| 4,509,550 | A | * | 4/1985 | Monk | 137/551 |
| 5,027,841 | A | * | 7/1991 | Breunsbach et al. | 134/95.3 |
| 5,032,186 | A | * | 7/1991 | Childers et al. | |
| 5,038,807 | A | * | 8/1991 | Bailey et al. | |
| 5,172,572 | A | * | 12/1992 | Ono | 68/12.02 |
| 5,259,219 | A | * | 11/1993 | Dausch et al. | |
| 5,422,276 | A | * | 6/1995 | Colvin | |
| 5,446,531 | A | * | 8/1995 | Boyer et al. | |
| 5,491,092 | A | * | 2/1996 | Colvin | |
| 5,498,347 | A | * | 3/1996 | Richard | 210/739 |

(Continued)

FOREIGN PATENT DOCUMENTS

DE 197 14 664 A 10/1998

(Continued)

OTHER PUBLICATIONS

European Patent Office 506,137 Mar. 1992.*

(Continued)

*Primary Examiner*—Frankie L. Stinson
(74) *Attorney, Agent, or Firm*—Gregory S. Bollis; James J. Sales; Renee J. Rymarz

(57) ABSTRACT

A device is provided for monitoring a wash process inside a mechanical washing apparatus, comprising sensor means for measuring physical and/or mechanical parameters of the wash process and recording means for recording the measured parameters within the device. This device comprises means for conducting a washing liquor past the sensor means and means for determining a certain contact time between the washing liquor and the sensor means.

10 Claims, 2 Drawing Sheets

U.S. PATENT DOCUMENTS 5,565,634 A * 10/1996 Graessle et al.
5,603,233 A * 2/1997 Erickson et al.
5,706,840 A * 1/1998 Schneider et al.
5,746,835 A * 5/1998 Turner et al.
5,767,775 A * 6/1998 Shukla et al. ..... 340/623
5,788,925 A * 8/1998 Pai et al.
5,792,435 A * 8/1998 Mueller et al. ..... 422/292
5,872,004 A * 2/1999 Bolsen ..... 435/287.4
5,875,783 A 3/1999 Kullik et al.
5,906,802 A * 5/1999 Langford
5,923,432 A * 7/1999 Kral
5,928,948 A * 7/1999 Malchesky
6,068,821 A * 5/2000 VanDeGraaf ..... 422/300
6,156,267 A * 12/2000 Pai et al. ..... 422/3
6,193,931 B1 * 2/2001 Lin et al.
6,220,267 B1 * 4/2001 Joshi ..... 137/9
6,323,032 B1 * 11/2001 Kuepper et al. ..... 436/1
6,516,818 B1 * 2/2003 Jacobs et al.
6,517,775 B1 * 2/2003 Wang et al. ..... 422/3
6,536,060 B1 * 3/2003 Janssens et al.

FOREIGN PATENT DOCUMENTS

DE 197 14 695 10/1998
JP 60-60729 * 4/1985
JP 7-294510 * 11/1995
JP 10-165913 * 6/1998
WO 96/21390 7/1996
WO 01/07702 A 2/2001

OTHER PUBLICATIONS

European Patent Office 549,467 Jun. 1993.*
WIPO WO 00/25887 May 2000.*
European Search Report dated Aug. 16, 2001.

* cited by examiner

DEVICE FOR MONITORING A WASH PROCESS

FIELD OF THE INVENTION

The invention relates to a device for monitoring a wash process inside a mechanical washing apparatus, comprising sensor means for measuring physical and/or mechanical parameters of the wash process and recording means for recording the measured parameters within the device.

With the expression "mechanical washing apparatus" each apparatus for washing objects is meant which functions based upon, at least, a mechanical action (however without excluding any other, such as for example chemical or biological, action). An example of such an apparatus may be a ware washing apparatus, however also apparatuses for washing other objects, such as for example laundry, are meant. Further, "physical" is to be understood as including biological and chemical too.

BACKGROUND OF THE INVENTION

The optimisation of the operation of mechanical washing apparatuses becomes more and more an important customer request. By such an optimisation not only the obtained performance of the apparatus may be optimised, but it also becomes possible to take into account other factors, such as an improved use of materials, a reduced energy consumption and a reduction of environmental pollution. It is evident that the possibility of optimising the operation of such an apparatus constitutes an increasingly important economical factor. As a first step to such an optimisation the parameters defining the wash process have to be determined.

It is an object of the present invention to provide an improved device for enabling such a determination.

DEFINITON OF THE INVENTION

Thus, according to the invention, the device is characterized by means for conducting a washing liquor past the sensor means and means for determining a certain contact time between the washing liquor and the sensor means. As a result the above-mentioned parameters can be determined in an effective way, notwithstanding the sometimes short periods the device is in contact with the washing liquor.

DETAILED DESCRIPTION OF THE INVENTION

The device according to the invention may be applied to different wash processes, industrial as well as domestic. Thus it is possible, that the wash process is a domestic laundry wash process, wherein the monitoring device is introduced into a revolving drum of a washing machine. Another possibility is, that the wash process is an industrial laundry wash process, wherein the monitoring device is introduced into a tunnel washing machine. In this latter case the device will follow the laundry through the entire tunnel, thus measuring at all different stages of the wash process.

However, the device according to the invention is not only applicable to a laundry wash process, but also to a ware wash process. Thus, the wash process might be a domestic ware wash process, wherein the monitoring device is introduced into a ware washer, but also the wash process might be an industrial ware wash process, wherein the monitoring device is introduced onto, and moves along with a conveyor belt of an industrial ware washer. In this aspect, the expression "ware" is to be understood as comprising, among others, dishes, bottles (glass as well as plastic), pots, pans etcetera.

According to a preferred embodiment of the device the sensor means are located in a central cavity of the device, wherein an entry channel connects the surroundings with the central cavity.

In the central cavity the sensor means are protected against damage, whereas nevertheless the entry channel exposes the sensor means to the washing liquor. The central cavity further contributes to a sufficient contact time. Further it is possible that the entry channel is provided with an entry funnel. Such a funnel promotes the entry of washing liquor into the device. Also further, an embodiment is proposed in which the entry channel is covered by a filter. Such a filter may physically block solids from the washing liquor to avoid soiling of the sensor means.

When the central cavity further connects with the surroundings by means of an exit channel a continuous refreshment of the washing liquor in contact with the sensor means is guaranteed.

The means for determining a certain contact time between the washing liquor and the sensor means can be optimised in different ways. As a first possibility the cross-section of the exit channel is smaller than the cross-section of the entry channel. However it is also possible, that in the exit channel obstruction means are provided. Still another possibility is, that the entry channel and exit channel are interconnected by a meandering channel section, wherein the central cavity adjoins the meandering section.

In a preferred embodiment of the device according to the invention the entry channel extends substantially centrally of the device, whereas the exit channel comprises a circumferential slot extending radially outward from the central cavity. The washing liquor enters the device centrally (axially) through the entry channel and reaches the central cavity with sensor means. From there the washing liquor flows radially out of the device.

When, in this embodiment, the central cavity is surrounded by a ledge partially separating the central cavity from the exit channel, the above-mentioned contact time still can be enlarged. This contact time is also determined by the width of the slot.

In a very special embodiment the entry channel is shaped similar to a bottle. Thus the washing process within a bottle-washer may be reproduced and monitored. In its most simple form a bottle without its bottom is positioned on top of a basis supporting the sensor means. Exit means for the washing liquor should be provided preventing the bottle from overfilling.

When the device comprises attachment means for attaching it to the mechanical washing apparatus, it can follow predetermined tracks through the apparatus.

Another embodiment of the device is mentioned, wherein it is part of a diagnosis rack with substantially planar shape. Such a diagnosis rack is especially useful in an industrial dishwasher. If, for example, the diagnosis rack further comprises an array of sensor means, a two dimensional monitoring can be accomplished, such as of the temperature and mechanical action which both vary with the widthwise position within the apparatus (as an example the position and functioning of sprinklers for the washing liquor may be monitored effectively in this manner).

To obtain additional information about the washing process, the diagnosis rack further may comprise standard soiled substrates, such as plates or alike, enabling benchmarking the performance of the apparatus against other apparatuses. The degree of cleaning will provide a performance rating and from the pattern of remaining soil, additional information may be obtained.

Apart from the means mentioned before, the device may comprise other means enhancing its operation. Without being complete there may be mentioned means for the measurement of time (timer or clock), means for powering the device, and means for reading out the measured parameters by proximity to a docking station. The mechanical parameters may include, among others, force and acceleration (for example for the impact of a jet of washing liquor and the movements of the device, respectively). The physical parameters may include, among others, concentration, conductivity, pH, turbidity, redox, pCa, pNa and EC. The use of dynamic surface tension sensors is contemplated too.

The invention will be elucidated referring to the drawings in which embodiments of a device according to the invention are shown.

Figure 1:
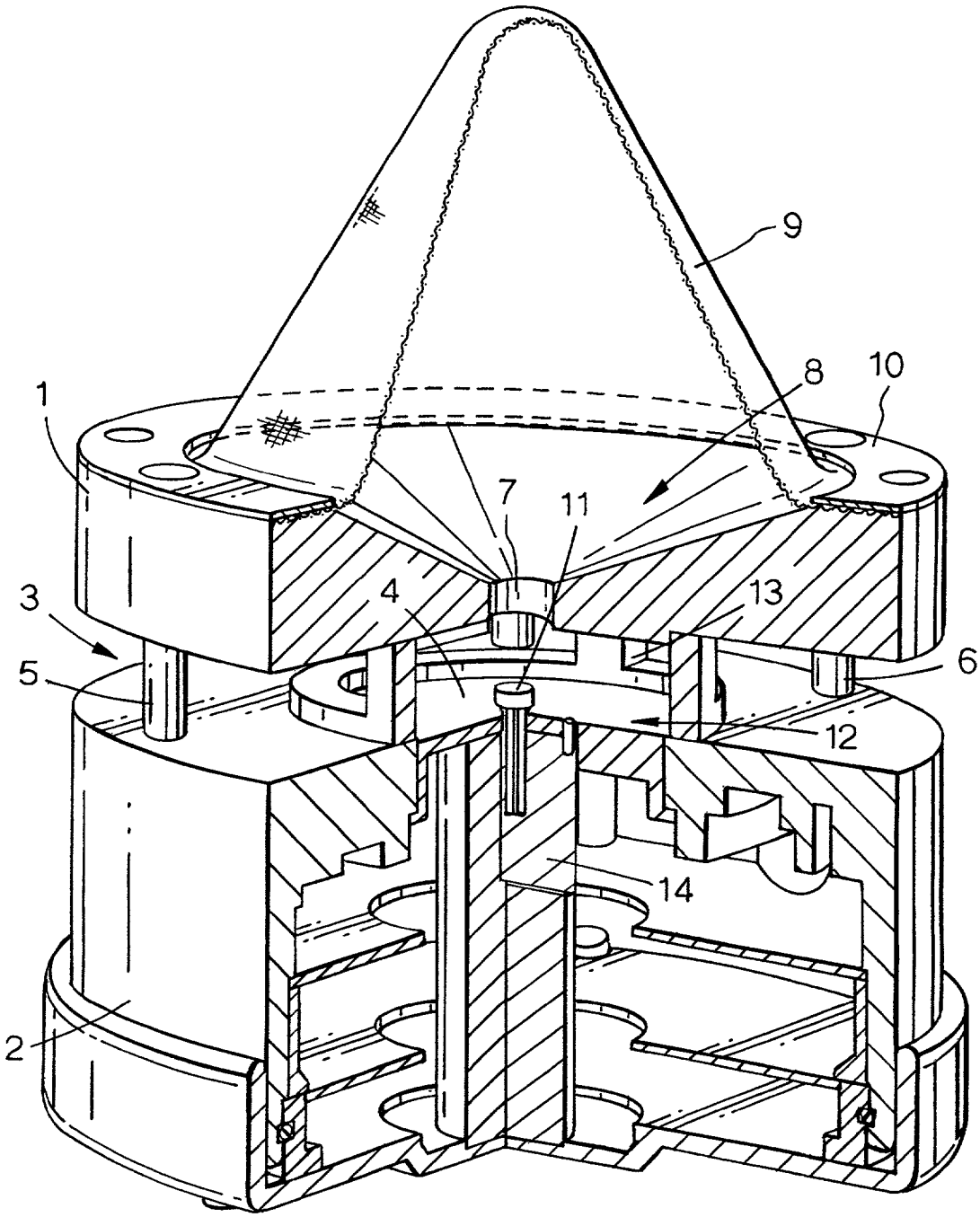
FIG. 1 shows, partly broken-away a perspective view of a first embodiment of the device according to the invention.

The device for monitoring a wash process inside a mechanical washing apparatus as shown in FIG. 1 comprises an upper housing part 1 and a lower housing part 2 separated by a circumferential slot 3 extending radially outward from a central cavity 4. The upper housing part 1 and lower housing part 2 are interconnected and kept at a certain distance by means of distance pins 5. Further a ground pin 6 is shown.

The central cavity 4 connects to the surroundings by an entry channel 7 provided with an entry funnel 8. Furthermore a filter 9, which is attached to the upper housing part 1 with a filter ring 10, covers the entry funnel 8 of the entry channel 7.

Within the central cavity 4 sensor means for measuring, among others, physical and/or mechanical parameters of the wash process are positioned. Of these sensor means FIG. 1 shows clearly a protruding temperature sensor 11. This temperature sensor 11, but also the other sensor means not illustrated, are positioned such in a sensor cartridge 12 that washing liquor entering the central cavity 4 through the entry funnel 8 and entry channel 7 will contact these sensor means. Thereafter the washing liquor will leave the device through the slot 3.

The central cavity 4 is surrounded by a ledge 13 partially separating the central cavity 4 from the slot 3 which functions as an exit channel. The dimensions of the ledge 13 as well as the dimensions of the slot 3 determine the flow rate of the washing liquor through the slot 3, and thus the contact time between the washing liquor and the sensor means. Among others, by amending the length of the distance pins 5 this flow rate may be amended. Thus, a sufficient contact time between the sensor means and entering washing liquor may be guaranteed, also in cases where the device resides only a short time in the washing liquor.

The interior 14 of the lower housing part 2 is hollow and houses several components of the device, such as recording means for recording the measured parameters, energy means for powering the device, means for measuring of the elapsed time, such as a timer or clock, and means for reading out the information stored in the recording means by proximity to a docking station etcetera. For example, parameters measured by the sensors means will be exchanged with an external device (not shown) by exchanging means, for example an inductive link. This inductive link also may be used for automatically recharging energy means such as batteries of the device when the monitoring device interacts with the external device. In such a case the batteries are rechargeable.

Figure 2:
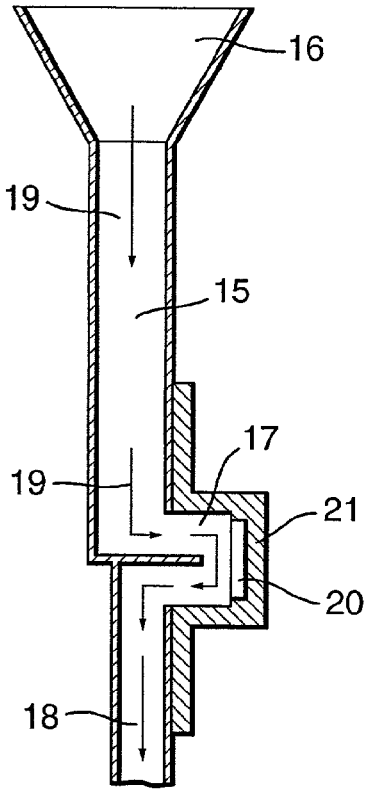
FIG. 2 shows, schematically, a second embodiment of the device according to the invention.

In FIG. 2 schematically a second embodiment of a monitoring device according to the invention is illustrated. An entry channel 15 with entry funnel 16 is connected to an exit channel 18 by means of a meandering channel section 17. The flow of a washing liquor is indicated by arrow 19.

The central part of the meandering channel section 17 is in contact with sensor means 20 which are surrounded by a housing 21 which may correspond with the lower housing part 2 of the embodiment according to FIG. 1.

The meandering channel section 17 creates a flow restriction, thus enabling a certain contact time between a washing liquor and the sensor means 20. Further, as visible in FIG. 2, the cross-section of the exit channel 18 is smaller than the cross-section of the entry channel 15. This also is helpful in providing a certain contact time. Another way of realising the desired contact time could be the provision of obstruction means in the exit channel 18 (not shown).

The device according to FIG. 2 is particularly useful for monitoring a wash process inside a mechanical ware washing apparatus or dishwasher.

Figure 3:
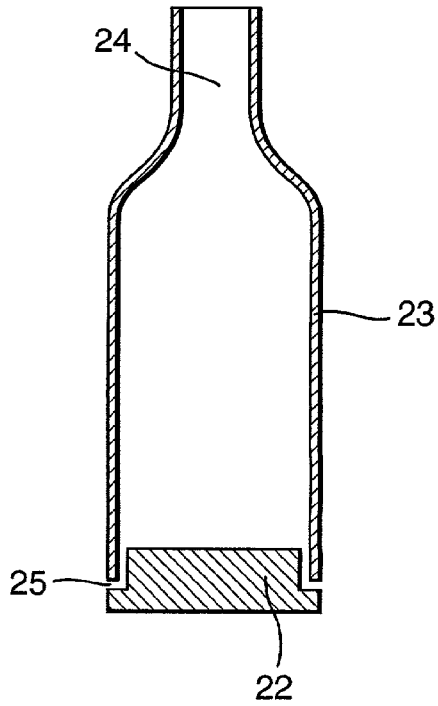
FIG. 3 shows, schematically, a third embodiment of the device according to the invention.

FIG. 3 shows, extremely simplified, the basic characteristic of still another embodiment of the monitoring device according to the invention. A base 22 is provided which might correspond with the lower housing part 2 according to FIG. 1, and which is provided with sensor means (not shown). On top of said base a bottle-like part 23 is positioned defining an entry channel 24. An exit channel 25 is defined between the lower part of the bottle-like part 23 and the base 22.

This embodiment of the device for monitoring a wash process is meant for use in a bottle-washer. The bottle-like part 23 simulates the conditions inside a bottle to be washed. By the way, the bottle-like part 23 indeed may be a bottle, of which the bottom has been removed.

Figure 4:
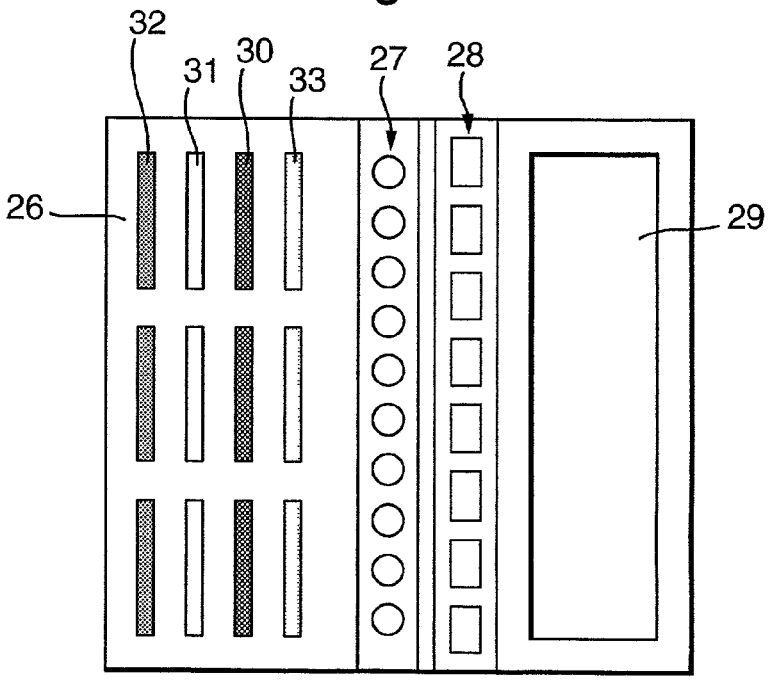
FIG. 4 shows, again schematically, a top plan view of a fourth embodiment of the device according to the invention.

Finally, reference is made to FIG. 4 in which a diagnosis rack 26 is shown in a top plan view. This diagnosis rack 26 is meant to be put on a conveyor belt of a mechanical ware washing apparatus and to travel along therewith through the apparatus, in the same way as the ware to be washed. Two parallel arrays 27 and 28 of sensors (for example, temperature sensors and pressure sensors) extend in parallel along the diagnosis rack 26. A space 29 is provided for other sensors, for energy means, for recording means or for a monitoring device, for example as illustrated in one of the previous figures. The rack (26) also contains means (not shown) for attaching a device according to the present invention as shown in FIG. 1 thereto.

The importance of such a diagnosis rack may be illustrated as follows. While travelling through a washing apparatus, the parameters to be measured vary. However, these parameters may also vary over the width of the conveyor belt, since for example sprinklers for the washing liquor may not be placed optimally, or due to wall effects. Therefore, a two-dimensional scan of, for example, the temperature and the mechanical action is performed by the arrays 27, 28 of sensors. This provides a good way to visualise the wash process inside of the apparatus. More particularly, this scan gives information on the value of the measured parameters over the width of the apparatus as a function of time (during the period wherein the rack travels through the apparatus).

Because the temperature, and especially the mechanical action, on the surface of the ware to be washed may be different from the values measured by the sensor arrays 27, 28, it is proposed to equip additional plates 30 with temperature and force sensors. Furthermore, the cleaning performance of a specific mechanical ware washing apparatus can be benchmarked against other apparatuses by putting standard soiled plates 31 on the diagnosis rack 26. The degree of cleaning of these standard soiled plates 31 will provide a performance rating and from the pattern of the remaining soil additional information may be obtained.

Finally, FIG. 4 shows shield plates 32 and customer soiled plates 33.

The invention is not limited to the embodiments described before which may be varied widely within the scope of the invention.

The invention claimed is:

1. Device for monitoring a wash process inside a mechanical washing apparatus, comprising sensor means for measuring physical and/or mechanical parameters of the wash process and recording means for recording the measured parameters within the device characterized by means for conducting a washing liquor past the sensor means and means for determining a certain contact time between the washing liquor and the sensor means, characterized in that the sensor means are located in a central cavity of the device and wherein an entry channel connects the surroundings with the central cavity and the central cavity further connects with the surroundings by means of an exit channel, further characterized in that the entry channel and exit channel are interconnected by a meandering channel section, wherein the central cavity adjoins the meandering section.

2. Device for monitoring a wash process inside a mechanical washing apparatus, comprising sensor means for measuring physical and/or mechanical parameters of the wash process and recording means for recording the measured parameters within the device characterized by means for conducting a washing liquor past the sensor means and means for determining a certain contact time between the washing liquor and the sensor means, characterized in that the sensor means are located in a central cavity of the device and wherein an entry channel connects the surroundings with the central cavity and the central cavity further connects with the surroundings by means of an exit channel, further characterized in that the entry channel extends substantially centrally of the device, whereas the exit channel comprises a circumferential slot extending radially outward from the central cavity.

3. Device for monitoring a wash process inside a mechanical washing apparatus, comprising sensor means for measuring physical and/or mechanical parameters of the wash process and recording means for recording the measured parameters within the device characterized by means for conducting a washing liquor past the sensor means and means for determining a certain contact time between the washing liquor and the sensor means, characterized in that the sensor means are located in a central cavity of the device and wherein an entry channel connects the surroundings with the central cavity and the central cavity further connects with the surroundings by means of an exit channel, further characterized in that the central cavity is surrounded by a ledge partially separating the central cavity from the exit channel.

4. A device positionable within a washing chamber of a mechanical washing apparatus for monitoring a wash process inside the mechanical washing apparatus, the device comprising a sensor means for measuring physical and/or mechanical parameters of the wash process from inside the washing chamber and a recording means for recording the measured parameters within the device, the device further characterized by a means for conducting a washing liquor past the sensor means and means for determining a certain contact time between the washing liquor and the sensor means, further characterized in that the sensor means are located in a central cavity of the device and wherein an entry channel connects the surroundings with the central cavity, characterized in that the entry channel is shaped similar to a bottle that is washed within chamber.

5. A device positionable within a washing chamber of a mechanical washing apparatus for monitoring a wash process inside the mechanical washing apparatus, the device comprising a sensor means for measuring physical and/or mechanical parameters of the wash process from inside the washing chamber and a recording means for recording the measured parameters within the device, the device further characterized by a means for conducting a washing liquor past the sensor means and means for determining a certain contact time between the washing liquor and the sensor means, further characterized in that the sensor means are located in a central cavity of the device and wherein an entry channel connects the surroundings with the central cavity, the central cavity further connects with the surroundings by means of an exit channel, wherein the entry channel and exit channel are interconnected by a meandering channel section, wherein the central cavity adjoins the meandering section.

6. A device positionable within a washing chamber of a mechanical washing apparatus for monitoring a wash process inside the mechanical washing apparatus, the device comprising a sensor means for measuring physical and/or mechanical parameters of the wash process from inside the washing chamber and a recording means for recording the measured parameters within the device, the device further characterized by a means for conducting a washing liquor past the sensor means and means for determining a certain contact time between the washing liquor and the sensor means, further characterized in that the sensor means are located in a central cavity of the device and wherein an entry channel connects the surroundings with the central cavity, the central cavity further connects with the surroundings by means of an exit channel, wherein the entry channel extends substantially centrally of the device, and the exit channel comprises a circumferential slot extending radially outward from the central cavity.

7. A device positionable within a washing chamber of a mechanical washing apparatus for monitoring a wash process inside the mechanical washing apparatus, the device comprising a sensor means for measuring physical and/or mechanical parameters of the wash process from inside the washing chamber and a recording means for recording the measured parameters within the device, the device further characterized by a means for conducting a washing liquor past the sensor means and means for determining a certain contact time between the washing liquor and the sensor means, further characterized in that the sensor means are located in a central cavity of the device and wherein an entry channel connects the surroundings with the central cavity, the central cavity further connects with the surroundings by means of an exit channel, wherein the central cavity is surrounded by a ledge partially separating the central cavity from the exit channel.

8. A device positionable within a washing chamber of a mechanical washing apparatus for monitoring a wash process inside the mechanical washing apparatus, the device comprising a sensor means for measuring physical and/or mechanical parameters of the wash process from inside the washing chamber and a recording means for recording the measured parameters within the device, the device further characterized by a means for conducting a washing liquor past the sensor means and means for determining a certain contact time between the washing liquor and the sensor means characterized in that it is part of a diagnosis rack with substantially planar shape, further characterized in that the diagnosis rack further comprises standard soiled substrates, such as plates or alike.

9. A device positionable within a washing chamber of a mechanical washing apparatus for monitoring a wash process inside the mechanical washing apparatus, the device comprising a sensor means for measuring physical and/or mechanical parameters of the wash process from inside the washing chamber and a recording means for recording the measured parameters within the device, the device further characterized by a means for conducting a washing liquor past the sensor means and means for determining a certain contact time between the washing liquor and the sensor means characterized in that it is part of a diagnosis rack with substantially planar shape, further characterized in that the diagnosis rack is capable of making a 2-dimensional scan of the measured parameters.

10. A device for monitoring a wash process inside a mechanical washing apparatus, the device comprising:

a housing that can be received within a washing chamber of the washing apparatus during a wash cycle, the housing configured to conduct washing fluid through a flow path having an entry, an exit, and an obstruction positioned along the flow path to control the flow rate of washing fluid through the housing, the flow path having a funnel at least partially defining the entry of the flow path;

a filter positioned over the funnel, the filter having a generally conical shape extending away from the funnel;

a sensor coupled to the housing and positioned contiguous the flow path to measure physical and/or mechanical parameters of a wash process; and a recording device coupled to the housing and in communication with the sensor to record measured parameters.

* * * * *